US005236044A

United States Patent [19]

Nagasaka et al.

[11] Patent Number: 5,236,044

[45] Date of Patent: Aug. 17, 1993

[54] HEAT EXCHANGER TANK PARTITION DEVICE

[75] Inventors: Yoshikiyo Nagasaka; Teruyuki Nagao, both of Kohnan, Japan

[73] Assignee: Zexel Corporation, Japan

[21] Appl. No.: 679,115

[22] Filed: Apr. 2, 1991

[30] Foreign Application Priority Data

Apr. 5, 1990 [JP] Japan ..... 2-36928[U]

[51] Int. Cl.[5] ..... F28F 9/02

[52] U.S. Cl. ..... 165/176; 165/173; 29/890.052

[58] Field of Search ..... 165/176, 173, 174, 153; 29/890.052

[56] References Cited

U.S. PATENT DOCUMENTS 1,862,707 6/1932 Rifenberick et al. ..... 165/176
3,776,303 12/1973 Anderson et al. ..... 165/176
4,936,381 6/1990 Alley ..... 165/176
5,069,277 12/1991 Nakamura et al. ..... 165/173
5,107,926 4/1992 Calleson ..... 165/173

FOREIGN PATENT DOCUMENTS 360362 3/1990 European Pat. Off. .
379701 8/1990 European Pat. Off. .
377936 7/1991 European Pat. Off. .

*Primary Examiner*—Albert W. Davis, Jr.
*Attorney, Agent, or Firm*—Ostrolenk, Faber, Gerb & Soffen

[57] ABSTRACT

A heat exchanger tank partition device in which tank portions are partitioned into chambers by partition plates held between a pair of separable tank plates. These partition plates can be located into the required position, which facilitates assembly and provides good precision and brazing integrity. The result is a simple and secure arrangement which minimizes the risk of leakage of the heat exchange medium occurring.

14 Claims, 6 Drawing Sheets

HEAT EXCHANGER TANK PARTITION DEVICE

BACKGROUND OF THE INVENTION

1. Field of the Invention

The present invention relates to a partition device for use in a heat exchanger, and more particularly to a heat exchanger tank partition device which changes the flow path of the heat exchange medium passing through the heat exchanger.

2. Description of the Prior Art

Heat exchange devices used in conventional air-conditioning equipment and the like include heater cores of heater units and cooler unit evaporators and condensers. One such heat exchanger is the parallel flow type which is equipped with a multiplicity of tubes, through which a prescribed heat exchange medium flows, and a header which links these tubes and through which the heat exchange medium flows into and out of the tubes.

In order to increase the heat exchange efficiency, the flow path of the heat exchange medium is changed by partitioning the tank into a plurality of separate chambers. This arrangement can also be used to improve internal thermal conductivity by extending the overall length of the flow path and raising the flow velocity of the heat exchange medium in the tubes.

In the case of a cooler unit, for example, if the amount of coolant in the condenser is always the same the condenser structure could be designed in accordance with the said amount of coolant. In practice, however, there is always some differences in the quantity of coolant used owing to differences in service conditions from unit to unit. When the quantity of coolant is smaller, the nature of the coolant being what it is, it flows along the path of least resistance, producing an uneven flow which impedes the transition of the liquid coolant to the vapor phase, resulting in poor heat exchange efficiency. The cooling medium has three phase states, vapor phase, dual-phase vapor-liquid state, and liquid phase, with the dual-phase vapor-liquid state providing the best heat exchange efficiency. With respect to air-conditioned air having a thermal load, higher heat exchange efficiencies are achieved even with a smaller quantity of coolant by cycling the coolant through the system a number of times, as in the case of two or three pass systems. However, too many passes will produce resistance when there is a larger quantity of coolant, and overcooling when there is a smaller quantity of coolant. With respect to the design of condensers and other heat exchangers, it therefore becomes a matter of selecting the optimum number of passes. Achieving the requisite number of passes is ensured by partitioning heat exchanger tanks into the requisite number of chambers.

Disclosures of arrangements for providing such partitioning include that of Japanese Laid-open Patent Application No. 63-49193/1988. The principal parts of a such a conventional heat exchanger tank partition arrangement using a two-pass parallel-flow condenser will now be described, with reference to FIGS. 12 to 14.

With reference to FIG. 12, which shows a cross-sectional plan view of the condenser 1, coolant (heat exchange medium) from a compressor (not shown) is introduced into a first tank portion 2, passes through a multiplicity of outward tubes 3, a second tank portion 4 and a multiplicity of inward tubes 5, and from there into the liquid tank (not shown) of the next stage.

The first tank portion 2 is divided into an outward tank chamber 2A and an inward tank chamber 2B by a round partition plate 6. Fins 7 are disposed between tubes 3 and 5.

FIG. 13 is an enlarged plan view showing a simplified representation of the arrangement for the partitioning of the first tank portion 2, and FIG. 14 is a front view of the round partition plate 6. A partition groove 8 that is as wide as the thickness of the round partition plate 6 is formed at the point at which the first tank portion 2 is partitioned, and formed in the round plate 6 is a cutout portion 9 the depth of which equals the thickness of the first tank portion 2. After the round plate 6 is fitted into the partition groove 8, the round plate 6 is brazed to the first tank portion 2.

However, this arrangement can give rise to problems of reliability. This is owing to the fact that as the round plate 6 is merely fitted into the partition groove 8, any deflection of the round plate 6 that may occur during assembly or transportation, or during positioning in the brazing chamber (not shown), can mar the integrity of the brazing, causing the heat exchange medium to leak and making repairs necessary.

There are also problems relating to manufacturing efficiency. That is, forming the partition requires the steps of forming the partition groove 8 in the tank portion, stamping the cutout portion 9 in the round plate 6 inserting the round plate 6 into the partition groove 8 and attaching the plate 6, and care has to be taken to ensure that there will be no leakage of coolant.

SUMMARY OF THE INVENTION

In view of the above drawbacks and defects, an object of the present invention is therefore to provide a reliable heat exchanger tank partition device whereby there is little risk of the heat exchange medium leaking, by an arrangement for simply and securely positioning and fastening partition plates at the required locations in the tank portion of a heat exchanger to divide the tank portion into a required number of tank chambers.

The heat exchanger tank partition device according to the present invention comprises tubes through which flows a heat exchange medium, a tank portion which connects a multiplicity of the tubes and through which the heat exchange medium flows in and out, and partition plates for dividing the tank portion into a plurality of independent tank chambers, wherein a tank portion is formed by a first tank plate and a second tank plate which can be radially separated, with at least one of the tank plates having formed thereon positioning and engagement portions such as positioning and engagement hole means or positioning and engagement groove means for engaging with the partition plates and wherein the partition plates can be positioned between the first and second tank plates to form the tank chambers.

In the heat exchanger tank partition device according to the present invention, the tank portion is formed by a first tank plate and a second tank plate which can be radially separated and can be formed into tank chambers by disposing partition plates therebetween.

In addition, formed on at least one of the first and second tank plates are positioning and engagement portions which engage with the partition plates, facilitating and ensuring the positive positioning of the partition plates for forming the tank chambers.

Thus, with this arrangement it is easy to position and secure the partition plates in the tank portions and there is no displacement of the partition plates in the tank portions during the subsequent brazing step or of other problems involved in the prior art arrangements, such as defective brazed joints resulting from a misfit between partition plate and partition groove, and leakage of heat exchange medium caused by such problems, enabling reliable heat exchangers to be manufactured with good efficiency.

Further features of the invention, its nature and various advantages will become more apparent from the accompanying drawings and following detailed description of the invention.

DESCRIPTION OF THE PREFERRED EMBODIMENTS

Figure 12:
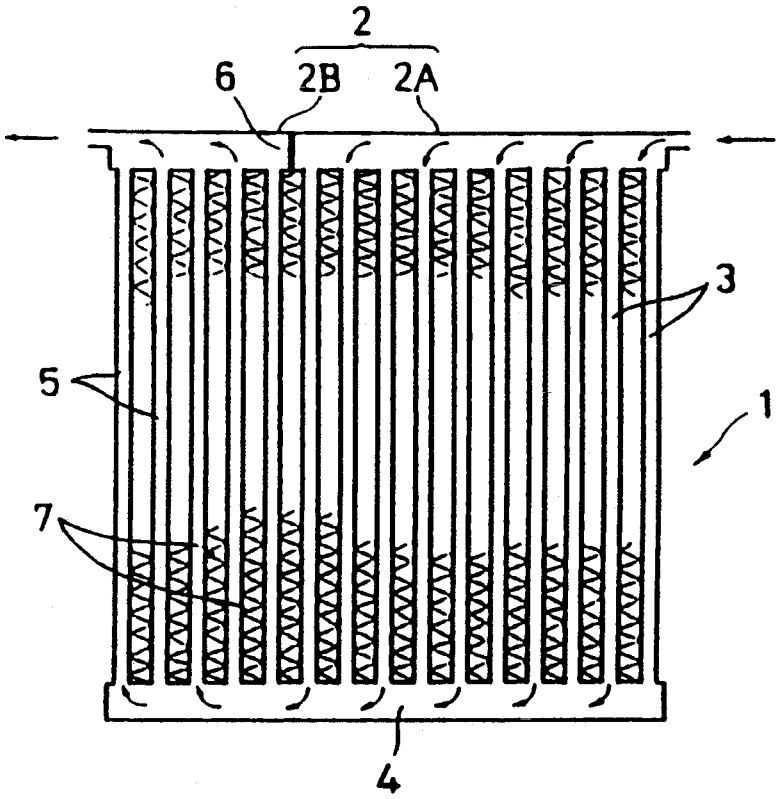
FIG. 12 PRIOR ART
FIG. 12 is a cross-sectional plan view of a prior-art heat exchange condenser.
Figure 13:
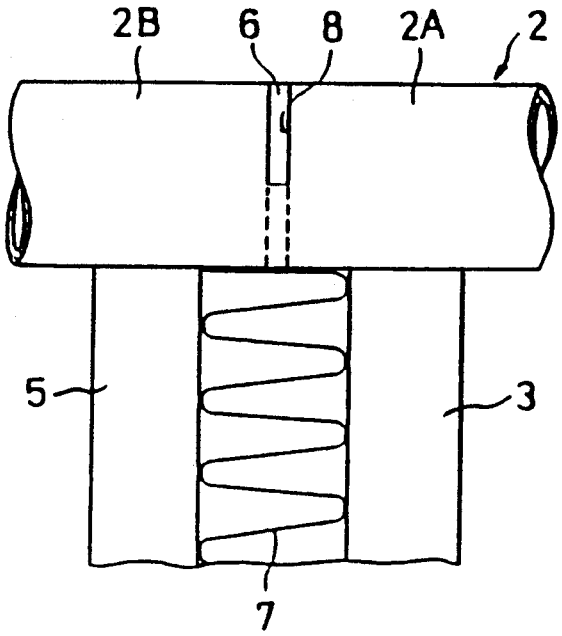
FIG. 13 PRIOR ART
FIG. 13 is an enlarged cross-sectional plan view of the principal parts of the partitioning of a first tank portion.
Figure 14:
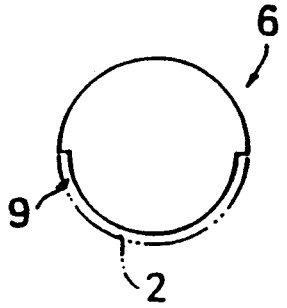
FIG. 14 PRIOR ART
FIG. 14 is a front view of the round partition plate used in the same arrangement.

A first embodiment of the heat exchanger tank partition device according to the present invention, applied to a condenser, will now be described with reference to FIGS. 1 to 6. Parts which are the same as those in FIGS. 12 to 14 have been given the same reference numerals, and repetition of the details of such parts is omitted.

Figure 1:
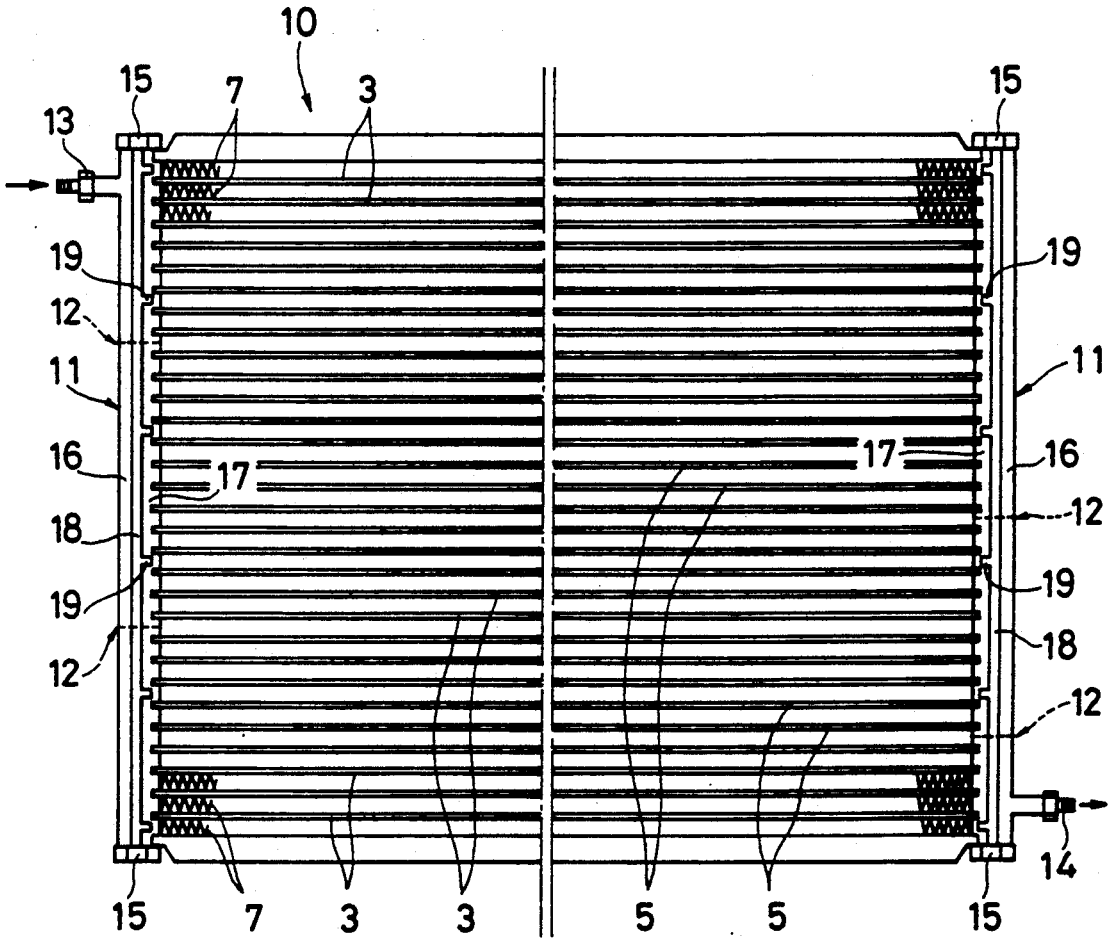
FIG. 1 is a front view of the tank portions in a heat exchanger tank partition device according to a first embodiment of the present invention.
Figure 2:
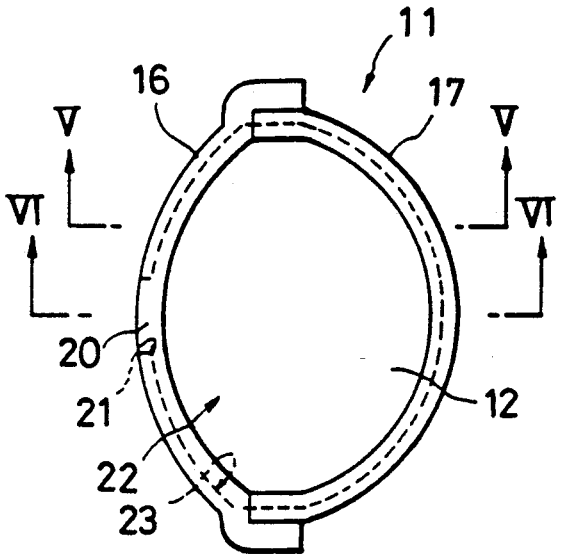
FIG. 2 is a cross-sectional view of the principal parts of the tank portions with partition plates inserted.
Figure 3:
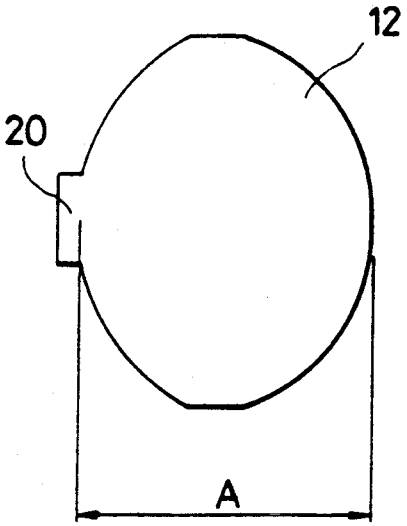
FIG. 3 is a front view of one of the partition plates.
Figure 4:
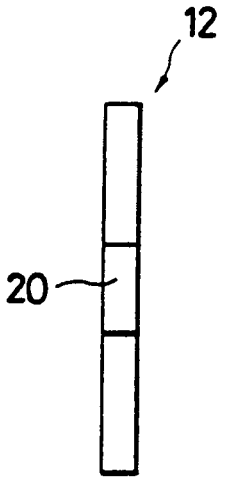
FIG. 4 is a left-side view of one of the partition plates

FIG. 1 is a front view of tank portions 11 (such as the above-described first tank portion 2 or second tank portion 4, for example) of a condenser 10 incorporated in the above heat exchanger tank partition device, FIG. 2 is a cross-sectional view of the principal parts of the tank portions 11 showing the partition plates 12 inserted in position, FIG. 4 is a front view of a partition plate 12, and FIG. 4 is a left-side view of the partition plate 12.

With reference to FIG. 1, the tank portions 11 are connected to an inlet joint 13 and an outlet joint 14, and have caps 15 affixed at the top and bottom. As shown by FIGS. 1 and 2, the tank portions 11 are formed by a first tank plate 16 and a second tank plate 17 which are radially separable. The first tank plate 16 has a connecting portion 18 formed therein extending longitudinally along the plate. This connecting portion 18 engages with the outer ends of the second tank plate 17.

Provided at prescribed intervals along the connecting portion 18 are presser projections 19 which are caulked to enable them to be provisionally attached to the tank plates 16 and 17 prior to the brazing. An engaging projection 20 is formed on each partition plate 12.

Figure 6:
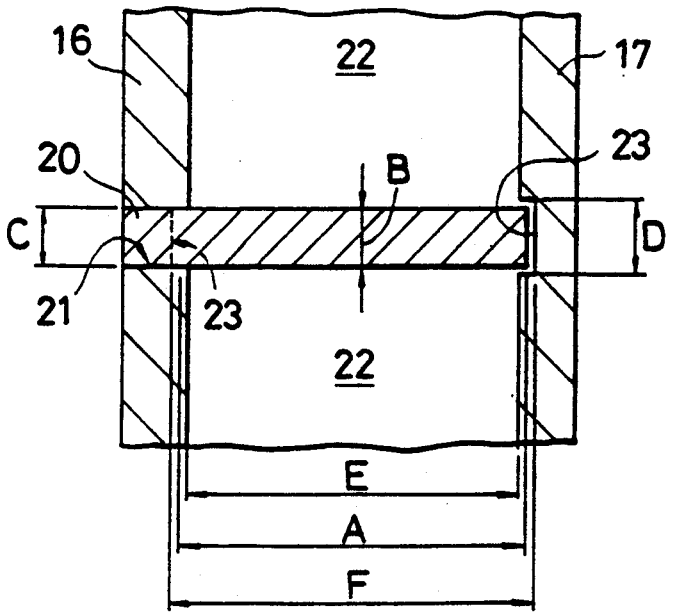
FIG. 6 is a cross-sectional view along the line VI—VI of FIG. 1.

With reference to FIGS. 2 and 6, each of the first tank plates 16 is provided with a positioning and engagement hole 21 for engagement with the partition plate 12 engaging projection 20.

Figure 5:
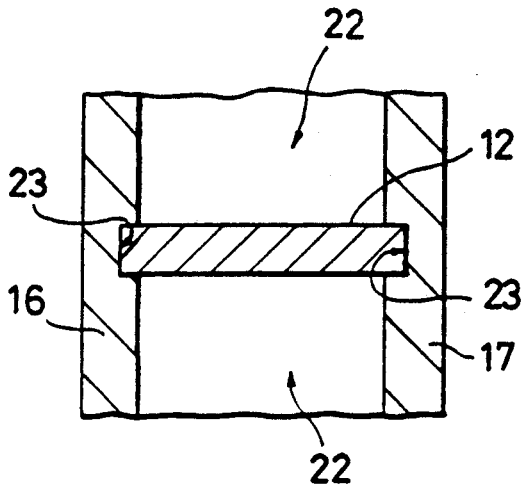
FIG. 5 is a cross-sectional view along the line V—V of FIG. 1.

As illustrated by FIGS. 2, 5 and 6, a positioning and engagement groove 23 is formed around the inner periphery of the tank chamber 22 formed by the combination of the first tank plate 16 and second tank plate 17, at the position of the engagement hole 21. This engagement groove 23 can engage with the rim of the partition plate 12. Thus, in this embodiment the positioning and engagement means is constituted by the engagement hole 21 and engagement groove 23.

The dimensional relationship among the partition plates 12, engaging projection 20, engagement hole 21 and engagement groove 23 will now be explained with particular reference to FIG. 6.

If A is the cross-spa of the partition plate 12 from the base of the engaging projection 20 (FIG. 3), B is the thickness of the partition plate 12 (and engaging projection 20), C is the width of the engagement hole 21, D is the width of the engagement groove 23, E is the inner diameter of the tank chamber 22, and F is the inner diameter of the engagement groove 23, then the dimensions are set so that $$C \approx B < D$$

and $$E < A < F.$$

By making the dimensions so that $C \approx B < D$, after engaging projection 20 is located in engagement hole 21, the task of locating the partition plate 12 in the engagement groove 23 is facilitated. Moreover, the relationship $E < A < F$ ensures that brazing can be performed with the partition plate 12, first tank plate 16 and second tank plate 17 in perfect engagement, resulting in a good braze and a product in which there is no risk of leakage of the heat exchange medium.

To assemble the tank portion 11 arranged thus, first the engaging projection 20 of the partition plate 12 is inserted into the engagement hole 21 of the first tank plate 16 to fix the partition plate 12 in the prescribed position. Then, the second tank plate 17 only needs to be brought into engagement with the first tank plate 16 and the rim of the partition plate 12 inserted into the engagement groove 23.

This assembly process permits positive positioning of the partition plate 12, and is facilitated and made more secure by the fact that this can be observed while the second tank plate 17 is inserted into position. In addition, the insertion of the rim of the partition plate 12 into the engagement groove 23 ensures good brazability.

The shape of the tank plates and the division format may be selected as required. The shape, number and position of the engaging projection and corresponding engagement portions (engagement hole 21 and engagement groove 23) also may be selected as required. For example, the engaging projection 20 and engagement hole 21 may be omitted with just the engagement groove 23 being formed on the partition plate 12.

Using an engagement hole 21 makes it possible to confirm whether or not the partition plate 12 is securely in position by seeing whether or not the engaging projection 20 has located in the engagement hole 21. Also, using an engagement groove 23 enables dimensional error between the partition plate 12 and the first and second tank plates 16 and 17 to be absorbed.

Figure 7:
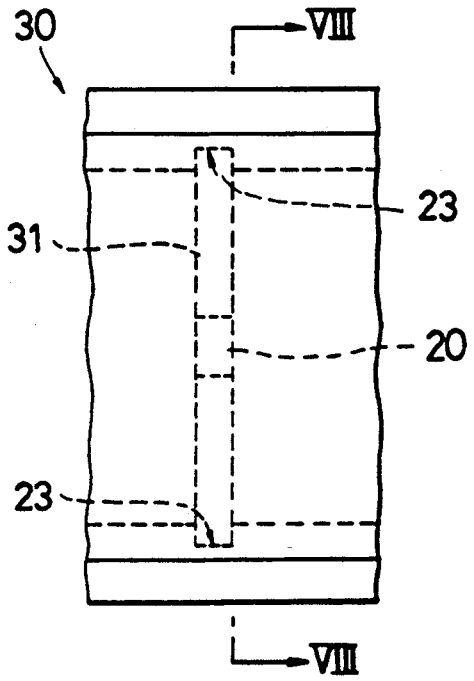
FIG. 7 is a side view of the tank portions in a heat exchanger tank partition device according to a second embodiment of the present invention.
Figure 8:
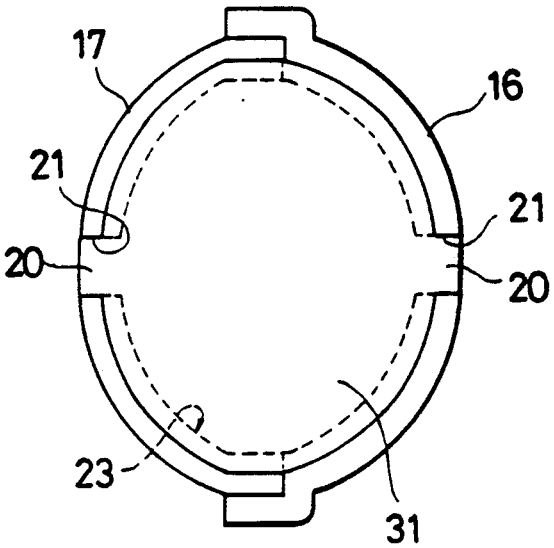
FIG. 8 is a cross-sectional view along the line VIII—VIII of FIG. 7.
Figure 9:
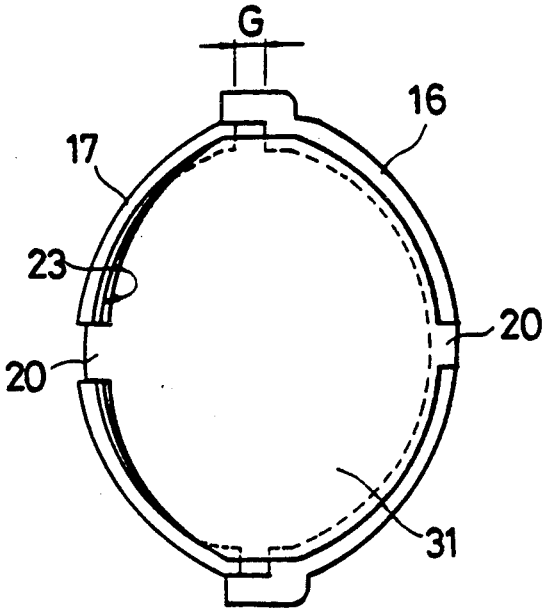
FIG. 9 is a side view thereof.

FIGS. 7 to 9 illustrate a second embodiment of the heat exchanger tank partition device according to the invention. In the tank portion 30 of this embodiment, a pair of engaging projections 20 is formed on a partition plate 31 and corresponding engagement holes 21 are formed in the first and second tank plates 16 and 17.

In accordance with this arrangement, lack of engagement between the partition plate 31 and the engagement grooves 23 will produce a displacement gap G between the first tank plate 16 and the second tank plate 17, as shown in FIG. 9. By thus enabling the lack of engagement to be confirmed, the device can be reassembled and aberrations corrected prior to the brazing step. Performing the brazing without eliminating the gap G will degrade the pressure-resistance strength of the tank chamber 22 and cause a bypass leak around the partition portion, degrading the performance of the product.

Figure 10:
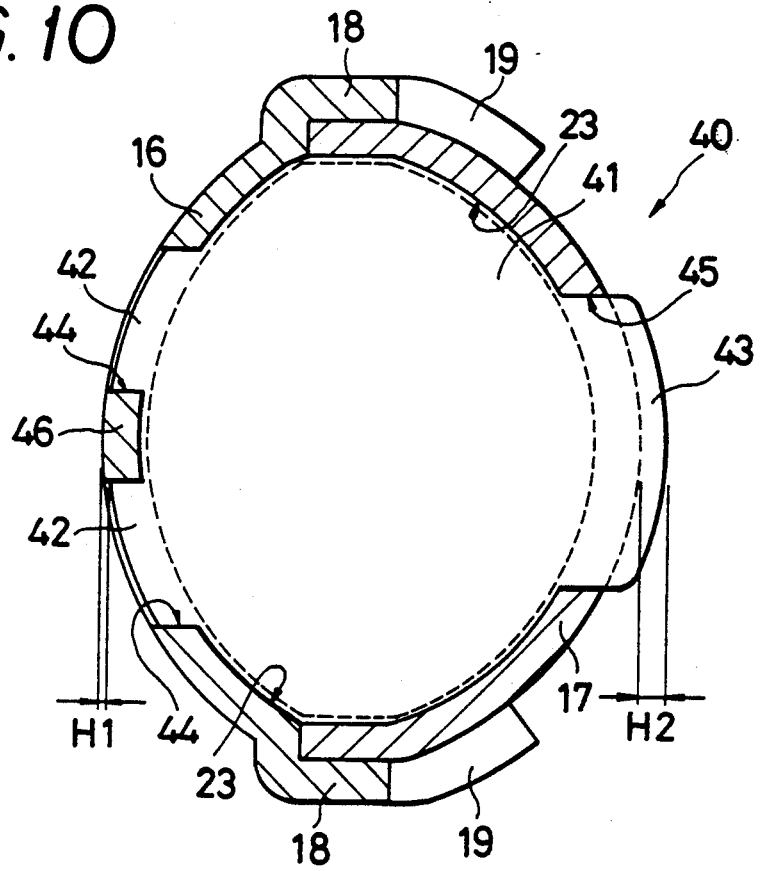
FIG. 10 is a cross-sectional view of the principal parts of the tank portion of a heat exchanger tank partition device according to a third embodiment of the invention.
Figure 11:
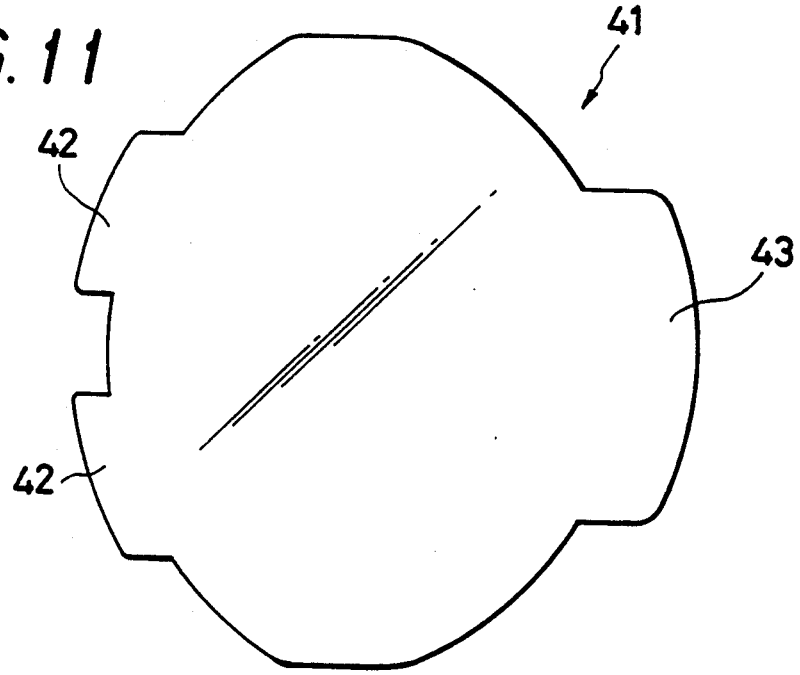
FIG. 11 is a front view of a partition plate of the third embodiment.

FIGS. 10 and 11 are views showing the principal parts of the tank portion of a heat exchanger tank partition device according to a third embodiment of the invention. In the tank portion 40, a pair of engaging projections 42 is provided on one side of a partition plate 41, and on the other side of the plate is a wide engaging projection 43.

Formed in the first tank plate 16 is a pair of engagement holes 44 in which the engaging projections 42 engage, and the second tank plate 17 is provided with a wide engagement hole 45 in which the engaging projection 43 engages. The portion between the engagement holes 44 of the first tank plate 16 is a brace 46.

The engaging projections 42 are arranged so that they are set back slightly from the peripheral surface of the first tank plate 16, producing a dimensional difference H1 between the peripheral surface of the first tank plate 16 and the front edges of the engaging projections 42. Also, the engaging projection 43 is arranged so that it protrudes slightly relative to the peripheral surface of the second tank plate 17, producing a dimensional difference H2 between the peripheral surface of the second tank plate 17 and the front edge of the engaging projection 43.

Thus the tank portion 40 is arranged so that the number of engaging projections on one side of the partition plate 41 is not the same as the number of engaging projections on the other side of the partition plate. Therefore even if the left and right sides of the first tank plate 16 and second tank plate 17 are symmetrical or have the same curvature, when inserting partition plates 41 into the first tank plate 16 and second tank plate 17, there is no risk of inserting a partition plate 41 the wrong way around.

Moreover, compared with the arrangements of the other embodiments, using the two pairs of engaging projections 42 and 43 provides a more extensive engagement with the first tank plate 16 and second tank plate 17, and hence a more secure engagement between the first and second plates 16 and 17 and the partition plates 41. In addition, the brace 46 strengthens the first tank plate 16.

Arranging the engaging projections 42 so that they are set back by the amount H1 from the peripheral surface of the first tank plate 16, the presence of the projections does not prevent a bracket being attached to the first tank plate 16 in order to, for example, affix the heat exchanger at a specific position in a vehicle or the like.

Also, the engaging projection 43 is arranged so that it protrudes from the peripheral surface of the second tank plate 17 by the amount H2. Therefore, the arrangement is such that after first bringing the partition plate 41 into engagement with the first tank plate 16, the engaging projection 43 can be used as a guide along which the second tank plate 17 is brought into position by the engagement of the engaging projection 43 with the engagement hole 45, improving the efficiency of the assembly operation.

What is claimed is:

1. A heat exchanger tank partition device comprising:

tubes through which flows a heat exchange medium;

tank portions which connect a multiplicity of the tubes and through which the heat exchange medium flows in and out;

partition plates for dividing the tank portions into a plurality of independent tank chambers, each partition plate including a positioning and engaging projection thereon, wherein:

the tank portions are each formed by a first tank plate and a second tank plate which are radially separated from each other and which together surround the chambers; each of the tank plates having formed thereon a respective positioning and engagement portion for locating and engaging with the partition plates said positioning and engagement portion including a positioning and engaging grove formed around the inner periphery of the tank chamber for receiving and engaging the periphery of the partition plate and said positioning and engagement portion further including a positioning and engagement hole formed on at least one of the tank plates for engaging and receiving the positioning and engagement projection; and the partition plates can be fastened between the first and second tank plates to form the tank chambers.

2. A heat exchanger tank partition device as defined in claim 1 provided with a multiplicity of positioning and engagement holes and projections.

3. A heat exchanger tank partition device as defined in claim 2 in which positioning and engagement holes are formed in the first tank plate and in the second tank plate.

4. A tank exchanger tank partition device as defined in claim 1 in which $$C \approx B$$

where B is the thickness of the positioning and engaging projection and C is the width of the positioning and engagement hole.

5. A heat exchanger tank partition device as defined in claim 1 in which $$C \approx B < D$$

where B is the thickness of the positioning and engaging projection, C is the width of the positioning and engagement hole and D is the width of the positioning and engagement groove.

6. A heat exchanger tank partition device as defined in claim 1 in which $$E<A<F$$

where A is the cross-span of the partition plate from the base of the positioning and engaging projection, E is the inner diameter of the tank chamber and F is the inner diameter of the positioning and engagement groove.

7. A heat exchanger tank partition device as defined in claim 1 in which the tubes are connected either to the first tank plate or to the second tank plate.

8. A heat exchanger tank partition device as defined in claim 1 in which a connecting portion is formed along one of either the first tank plate or second tank plate.

9. A heat exchanger tank partition device as defined in claim 8 in which the connecting portion is provided with presser projections which press against one of the tank plates from the outside.

10. A heat exchanger tank partition device as defined in claim 2 in which the number of engaging projections on one side of the partition plate is not the same as the number of engaging projections on the other side of the partition plate.

11. A heat exchanger tank partition device as defined in claim 10 in which a pair of engaging projections is provided on the side of the partition plate that engages with the first tank plate and a single engaging projection is provided on the side of the partition plate that engages with the second tank plate.

12. A heat exchanger tank partition device as defined in claim 10 in which a brace is formed on either the first tank plate or the second tank plate.

13. A heat exchanger tank partition device as defined in claim 1 in which the front edge of engaging projections is set back from the peripheral surface of either the first tank plate or second tank plate.

14. A heat exchanger tank partition device as defined in claim 1 in which the front edge of an engaging projection protrudes relative to the peripheral surface of either the first tank plate or the second tank plate.

* * * * *